US008322409B2

(12) United States Patent
Freyer

(10) Patent No.: US 8,322,409 B2
(45) Date of Patent: Dec. 4, 2012

(54) METHOD AND DEVICE FOR MAKING LATERAL OPENINGS OUT OF A WELLBORE

(76) Inventor: Rune Freyer, Stavanger (NO)

( * ) Notice: Subject to any disclaimer, the term of this patent is extended or adjusted under 35 U.S.C. 154(b) by 157 days.

(21) Appl. No.: 12/812,902

(22) PCT Filed: Mar. 4, 2009

(86) PCT No.: PCT/NO2009/000076

§ 371 (c)(1),
(2), (4) Date: Jul. 14, 2010

(87) PCT Pub. No.: WO2009/110804

PCT Pub. Date: Sep. 11, 2009

(65) Prior Publication Data

US 2011/0017445 A1 Jan. 27, 2011

(30) Foreign Application Priority Data

Mar. 6, 2008 (EP) ..... 08102342

(51) Int. Cl.
*E21B 43/00* (2006.01)

(52) U.S. Cl. ..... 166/50; 166/242.7; 175/61

(58) Field of Classification Search ..... 166/50, 166/242.3, 242.7; 175/50, 61, 62
See application file for complete search history.

(56) References Cited

U.S. PATENT DOCUMENTS

| | | | | |
|---|---|---|---|---|
| 4,527,639 | A | 7/1985 | Dickinson, III | |
| 4,763,734 | A | 8/1988 | Dickinson | |
| 5,941,308 | A * | 8/1999 | Malone et al. | 166/313 |
| 6,752,211 | B2 * | 6/2004 | Dewey et al. | 166/313 |
| 6,907,930 | B2 * | 6/2005 | Cavender et al. | 166/313 |
| 2004/0149444 | A1 | 8/2004 | Cavender et al. | |

FOREIGN PATENT DOCUMENTS

| | | | |
|---|---|---|---|
| NO | 323927 | B1 | 7/2007 |
| WO | 9960244 | A1 | 11/1999 |
| WO | 2006/054901 | A1 | 5/2006 |

OTHER PUBLICATIONS

International Search Report for parent application PCT/NO2009/000076, having a mailing date of Jun. 26, 2009.
Chinese Search Report for corresponding application CN 200980107177.9 dated Aug. 22, 2012.

* cited by examiner

*Primary Examiner* — William P Neuder
(74) *Attorney, Agent, or Firm* — Andrus, Sceales, Starke & Sawall, LLP

(57) ABSTRACT

A method and device for making lateral openings out of a wellbore in a well formation where fluid is made to flow through a motherbore tubular like a completion or production pipe and then through a needle pipe that is aimed at the formation, and where the method includes positioning a needle pipe that comprises at least one pipe section inside or outside a motherbore tubular; and arranging the at least one pipe sections to be telescopically displaceable with regard to an other pipe.

20 Claims, 4 Drawing Sheets

METHOD AND DEVICE FOR MAKING LATERAL OPENINGS OUT OF A WELLBORE

CROSS-REFERENCE TO RELATED APPLICATIONS

This application is the U.S. national stage application of International Application No. PCT/NO2009/000076, filed Mar. 4, 2009, which International application was published on Sep. 11, 2009, as International Publication No. WO 2009/110804 A1 in the English language, which application is incorporated herein by reference. The International application claims priority of European Patent Application No. 08102342.6, filed Mar. 6, 2008, which application is incorporated herein by reference.

BACKGROUND

There is provided a method for making lateral openings out of a wellbore. More precisely there is provided a method for making lateral openings out of a wellbore into a well formation, where fluid is made to flow through a motherbore tubular like a completion or production pipe and then through at least one needle pipe that is aimed at the formation. There is also provided a device for practicing the method.

The motherbore tubular forms a major conduit through at least a part of the wellbore, while the needle pipe is of a much smaller diameter and intended to be able to extend from the mother tubular and into the formation.

It is well known to treat a carbonate well formation with acid in order to stimulate the well.

According to prior art, relatively large quantities of hydrochloric acid have to be pumped into the well. Often the treatment has limited success. If the acid is not flowing into the intended sections of the well, the treatment may even lead to undesired increase in gas and water production.

The lack of desirable effects could be due to a breakdown of the formation matrix or that the acid follows natural fractures in the formation.

Several methods have been proposed for the purpose of improving the acid treatment. It is thus known to position a deflecting shoe at a lateral opening in the motherbore tubular. A jetting hose is then fed from the surface and deflected through the opening in the motherbore tubular and further on into the formation as the acid dissolves the formation. Although safeguarding that the acid is flowing into the desired part of the formation, the method is producing unnecessary large passages in the formation and the lateral openings are jetted sequentially.

Norwegian patent NO 323927 proposes to direct a narrow pipe towards the formation. Several narrow pipes may be positioned on the motherbore tubular, and a flowing acid or another fluid may thus produce a number of tiny openings in the formation. A disadvantage of this process is limited reach of the narrow pipes into the formation.

SUMMARY

The purpose of the invention is to overcome or reduce at lest one of the disadvantages of the prior art.

The purpose is achieved according to the invention by the features as disclosed in the description below and in the following patent claims.

There is provided a method for making lateral openings out of a wellbore in a well formation where fluid is made to flow through a motherbore tubular and then through a needle pipe that is aimed at the formation, where the method includes:

positioning a needle pipe that comprises at least one pipe section relative to a motherbore tubular;

arrange the at least one pipe sections to be telescopically displaceable with regard to another pipe; and the needle pipe penetrating the motherbore tubular's wall at an opening distant from the end of the motherbore tubular.

Normally the fluid is pumped from the surface and into the motherbore tubular.

An aspect of the method includes letting the at least one pipe section of the needle pipe be exposed to a differential pressure between the motherbore tubular and the annular pressure in the wellbore and thus hydraulically forced towards the formation.

A pipe device is provided for making lateral openings out of a wellbore in a well formation, where fluid is made to flow through a motherbore tubular and then through a needle pipe that is aimed at the formation, and where the pipe device is characterised by that the needle pipe comprises at least one pipe section where the at least one pipe section is arranged to be telescopically displaceable with regard to another pipe and where the needle pipe is penetrating the motherbore tubular at an opening distant from the end of the motherbore tubular.

An aspect of the pipe device is that at least one pipe section of the needle pipe is hydraulically injected towards the formation by the differential pressure inside the motherbore tubular relative the annular pressure in the wellbore. The pipe section is then approaching the formation simultaneously jetting a stream of fluid towards the formation, making lateral opening in the formation.

Another aspect of the pipe device is that the fluid is an acid, carbon dioxide, a combustible gas, a low viscosity fluid like water or any other fluid that is suitable for removing the formation matrix.

Yet another aspect of the pipe device is that the needle pipe is equipped with a drill motor at its leading end party.

A further aspect of the pipe device is that one of the at least two pipe sections of the needle pipe is fixedly positioned outside the motherbore tubular.

Another aspect of the pipe device is that at least one pipe section of the needle pipe is positioned inside the motherbore tubular. The needle pipe may thus be present in the motherbore tubular when the motherbore tubular is deployed in the well.

Yet another aspect of the pipe device is that the needle pipe is positionable at an opening in the motherbore tubular by the help of a tool. The tool may be a wire line or coiled tubing tool that is adapted to position objects at a desired position in a motherbore tubular. The use of a well tractor may be required.

Another aspect of the pipe device is that the needle pipe is equipped with a body that is adapted to place itself at an opening in the motherbore tubular when flowed into the motherbore tubular. Such bodies are well known in the industry, particularly in the form of drop balls for closing openings in the well.

A further aspect of the pipe device is that one pipe section of the needle pipe is equipped with at least one nozzle at its leading party, and where the direction of one nozzle is substantially forward in the direction of the lateral opening, and the direction of another nozzle is substantially opposite to provide a directional force.

The nozzles may be directable much in the same way as known from directional drilling.

It is a further aspect of the pipe device that the needle pipe is equipped with a filter. The filter will prevent foreign matter from blocking the nozzles.

Yet another aspect of the pipe device is that the needle pipe is equipped with a valve. The valve may be a check valve preventing flow in an undesirable direction.

An aspect of the pipe device is that at least one pipe section of the needle pipe is spliceable, in that the pipe section may consist of more than one pipe party.

As the needle pipes are hydraulically forced towards the formation in order to make the lateral openings, jetting, drilling or acid dissolving or combinations thereof may be utilized for breaking down the formation.

In order to secure that fluid is reaching also the most distant needle pipes and avoid unwanted fluid to enter the needle pipes, a closable check valve may be positioned below the position of the needle pipes. Fluid may thus flow through the mother tubular and onwards past the needle pipes passing the valve. When the desired fluid has reached the needle pipes, the valve will be closed.

After the lateral openings are made, the needle pipes may according to choice be left in the apertures, be withdrawn, be dissolved or in any other way be made unobtrusive.

A pipe device as suggested makes it possible to simultaneously penetrate the well formation by a number of relatively tiny lateral openings. The lateral openings may be positioned at desired positions in the formation, and thus reduce the fluid consumption to a fraction of that used when employing prior art techniques.

BRIEF DESCRIPTION OF THE DRAWINGS

Below, an example of an preferred device is explained under reference to the enclosed drawings, where.

DETAILED DESCRIPTION OF THE DRAWINGS

Figure 1:
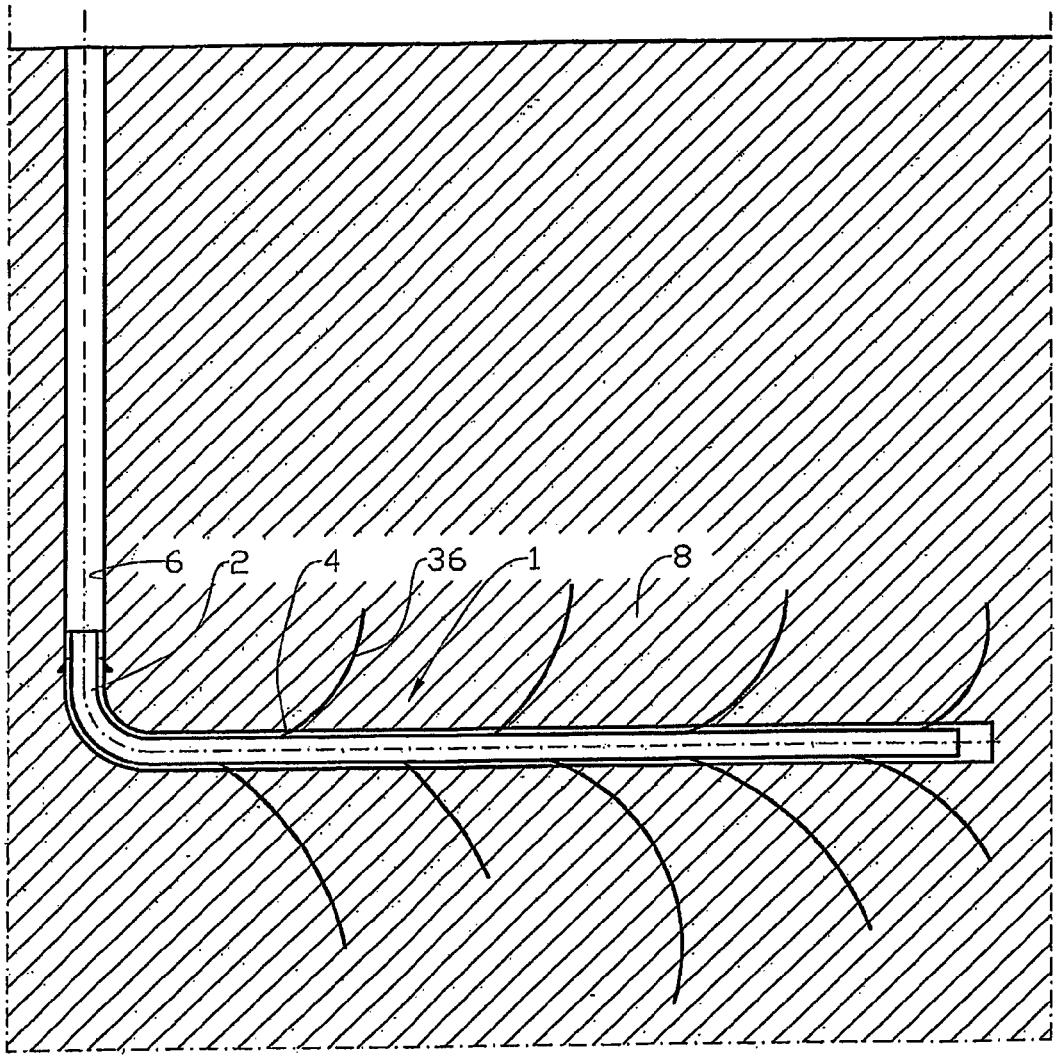
FIG. 1 schematic shows a well bore where lateral openings have been made into a formation by use of needle pipes.

On the drawings the reference number 1 denotes a pipe device that includes a motherbore tubular 2 in the form of a completion pipe, a production pipe or the like, and a number of needle pipes 4 that are telescopically displaceable.

The motherbore tubular 2 is positioned in a well bore 6 in an earth formation 8.

Figure 2:
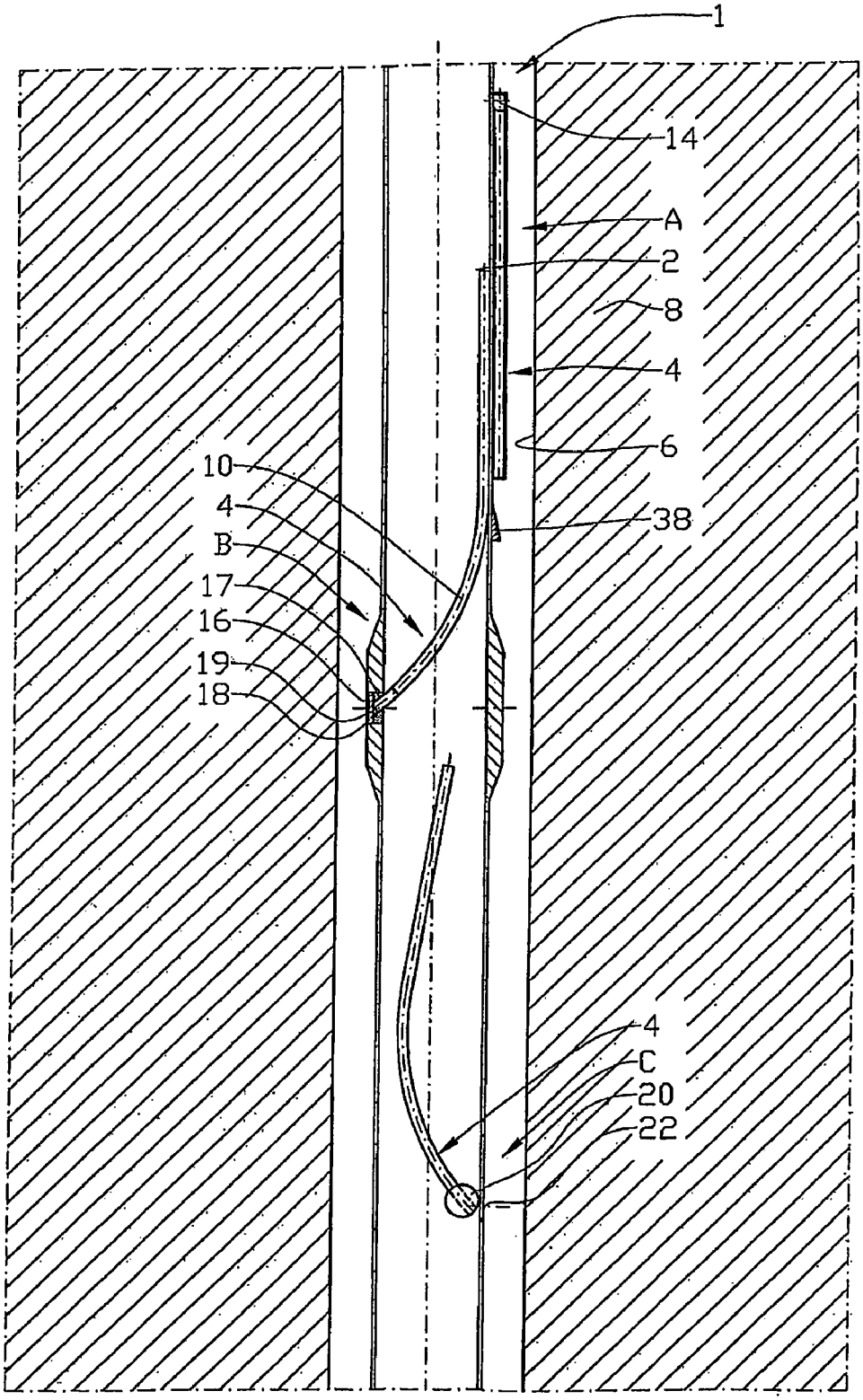
FIG. 2 schematic shows a section through a formation where a pipe device is positioned and where the needle pipes are ready to be activated.
Figure 3:
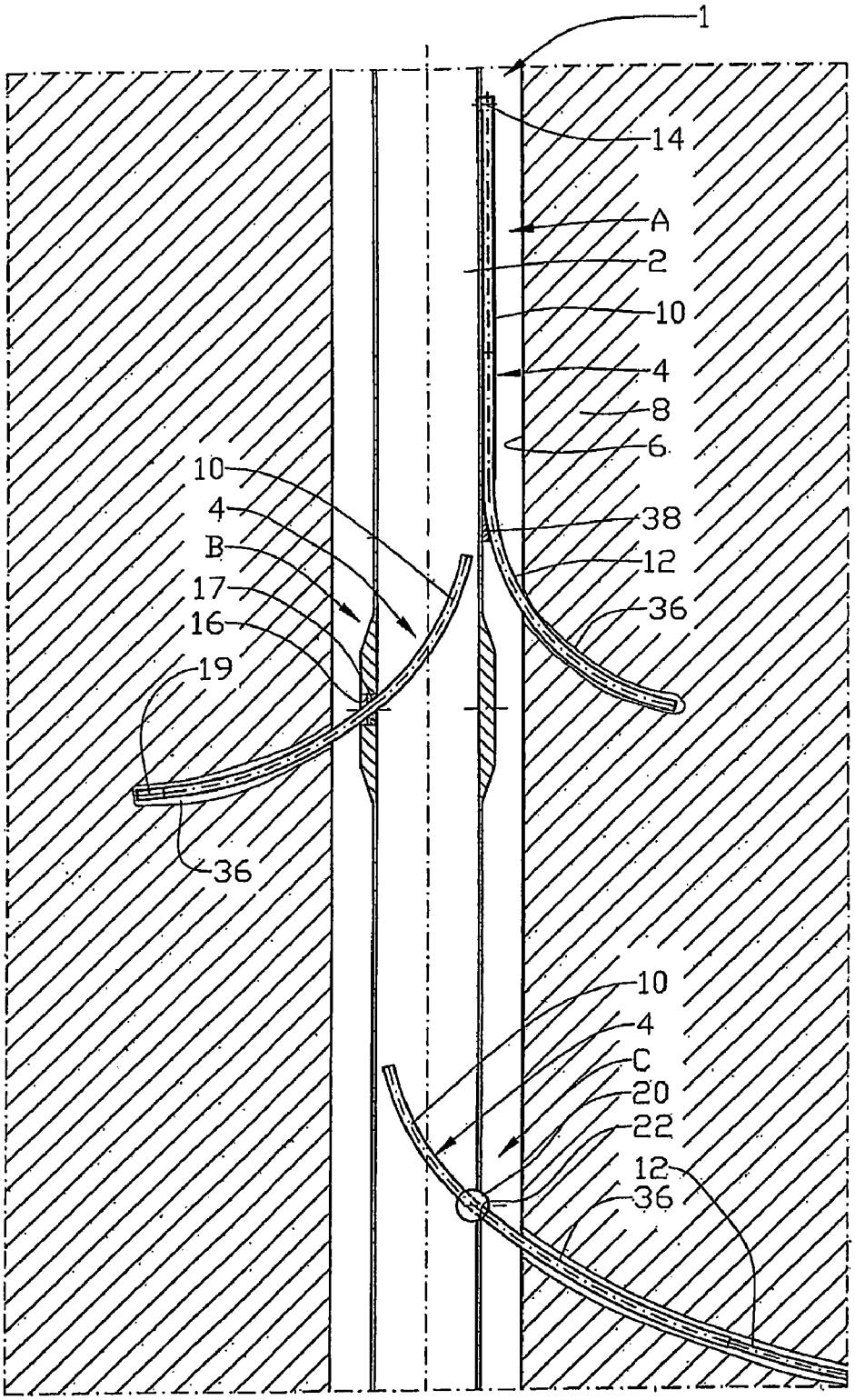
FIG. 3 shows the same as in FIG. 2, but here the needle pipes are activated.

In FIGS. 2 and 3 a number of possible ways of adapting the needle pipe 4 to the motherbore tubular 2 are indicated. At a layout "A" a first pipe section 10 of the needle pipe 4 is fixed to the outside of the motherbore tubular 2 while a second pipe section 12 is telescopically movable in the first pipe section 10. The needle pipe 4 communicates with the motherbore tubular 2 through a first opening 14 in the wall of the motherbore tubular 2.

At layout "B" the needle pipe 4 is mounted inside the motherbore tubular 2 where the leading end party of the needle pipe 4 is positioned at a second opening 16 in the wall of the motherbore tubular 2. A seal 17 is designed to seal between the second opening 16 and the needle pipe 4. The second opening 16 may preferably be closed by a plug 18, where the plug 18 is removable, for instance by a pressure difference, temperature or dissolvation. In the layout "B" the needle pipe 4 is equipped with a drill motor 19.

At layout "C" a needle pipe 4 is equipped with a body 20 at its leading end party. The body 20 is adapted to place itself at a third opening 22 in the wall of the motherbore tubular 2. At layout "C" in FIG. 2 the needle pipe 4 is shown at a position when the body 20 is about to position itself at the third opening 22 by following a fluid that is injected trough the motherbore tubular 2 and through the third opening 22.

Figure 4:
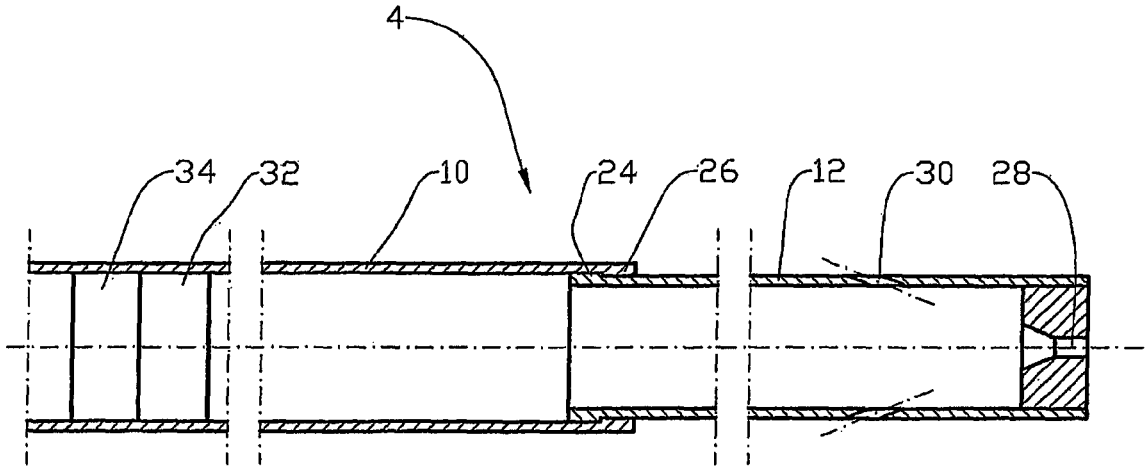
FIG. 4 shows in a larger scale a section through a needle pipe.

In FIG. 4 the second pipe section 12 is fully extended in the first pipe section 10. The second pipe section 12 is prevented from disengaging from the first pipe section 10 by a stop flange 24 on the second pipe section 12 that is abutting a stop collar 26 on the first pipe section 10.

At its leading end party the second pipe section 12 is equipped with a forward in the direction of the lateral opening directed nozzle 28 and at least one in the opposite direction directed nozzle 30.

Any of the pipe sections 10, 12 may be equipped with a filter 32 that is preventing the nozzles 28, 30 from being blocked during injection or production operations.

A valve 34, here in the form of a check valve for preventing reverse flow, is positioned in the first pipe section 10.

Other not shown valves may be present in the flow path between the motherbore tubular 2 and the needle pipe 4.

When the needle pipe 4 is to be activated, see FIG. 3, at least one of the pipe sections 10, 12 are extended into the formation 8 by a force from the differential pressure between inside the motherbore tubular 2 and the formation 8.

As the leading end party of the second pipe section 12 with the forwardly directed nozzle 28 is directed to the formation, as indicated in layout "A", an acid flow through the forwardly directed nozzle 28 is dissolving the formation 8 making an aperture 36 for the needle pipe to 4 to proceed through.

In layout "B" the drill motor 19 is drilling the lateral opening 36, while in layout "C" the lateral opening 36 is jetted by use of high pressure fluid.

A flow through the backwardly directed nozzle 30 provides a reaction force in the forward direction of the needle pipe 4.

At layout "A" the second pipe section 12 as it telescope out of the first pipe section 10 is bended towards the formation 8 by a wedge 38 on the motherbore tubular 2.

Alternatively, the second pipe section 12 may initially have been given a curvature, and thus bend itself towards the formation 8 as it is telescoping out of the first pipe section 10.

At layout "B" the needle pipe 4 is being forced out through the second opening 16 as the plug 18 has been dissolved.

At layout "C" the needle pipe 4 is being forced out through the body 20 that is positioned in the third opening 22.

The invention claimed is:

1. A method for making lateral openings out of a wellbore in a well formation, the method comprising:

positioning a needle pipe relative to a motherbore tubular that is disposed in the wellbore, the needle pipe having at least one pipe section that is aimed at the well formation;

wherein the at least one pipe section is telescopically displaceable with regard to another pipe; and wherein the needle pipe penetrates a wall of the motherbore tubular at an opening distant from an end of the motherbore tubular; and thereafter causing fluid to flow through the motherbore tubular and then through the needle pipe to make a lateral opening out of the wellbore.

2. A pipe device according to claim 1, wherein the fluid is an acid.

3. A pipe device according to claim 1, wherein the fluid is steam.

4. A pipe device according to claim 1, wherein the fluid is carbon dioxide.

5. A pipe device according to claim 1, wherein the fluid is a combustible gas.

6. A pipe device according to claim 1, wherein the fluid is low viscosity fluid.

7. A method for making lateral openings out of a wellbore in a well formation where fluid is made to flow through a motherbore tubular and then through a needle pipe that is aimed at the formation, wherein the method comprises:

positioning a needle pipe that comprises at least one pipe section relative to a motherbore tubular;

arranging the at least one pipe section to be telescopically displaceable with regard to another pipe; and the needle pipe penetrating the motherbore tubular's wall at an opening distant from the end of the motherbore tubular;

wherein the method includes letting the at least one pipe section of the needle pipe be submitted to a differential pressure between the motherbore tubular and the annular pressure in the wellbore and thus hydraulically forced towards the formation.

8. A pipe device for making lateral openings out of a wellbore in a well formation where fluid is made to flow through a motherbore tubular and then through a needle pipe that is aimed at the formation, wherein the needle pipe comprises at least one pipe section where the at least one pipe section is arranged to be telescopically displaceable with regard to another pipe and where the needle pipe is penetrating the motherbore tubular at an opening distant from the end of the motherbore tubular;

wherein one of at least two pipe sections of the needle pipe is fixedly positioned outside the motherbore tubular.

9. A pipe device for making lateral openings out of a wellbore in a well formation where fluid is made to flow through a motherbore tubular and then through a needle pipe that is aimed at the formation, wherein the needle pipe comprises at least one pipe section where the at least one pipe section is arranged to be telescopically displaceable with regard to another pipe and where the needle pipe is penetrating the motherbore tubular at an opening distant from the end of the motherbore tubular;

wherein one of the pipe sections is equipped with at least one nozzle at its leading end part.

10. A pipe device according to claim 9, wherein the direction of the nozzle is substantially forward in the direction of the lateral opening.

11. A pipe device according to claim 9, wherein the direction of the nozzle is substantially opposite the direction of the nozzle.

12. A pipe device for making lateral openings out of a wellbore in a well formation where fluid is made to flow through a motherbore tubular and then through a needle pipe that is aimed at the formation, wherein the needle pipe comprises at least one pipe section where the at least one pipe section is arranged to be telescopically displaceable with regard to another pipe and where the needle pipe is penetrating the motherbore tubular at an opening distant from the end of the motherbore tubular;

wherein the needle pipe is equipped with a drill motor at its leading end part.

13. A pipe device for making lateral openings out of a wellbore in a well formation where fluid is made to flow through a motherbore tubular and then through a needle pipe that is aimed at the formation, wherein the needle pipe comprises at least one pipe section where the at least one pipe section is arranged to be telescopically displaceable with regard to another pipe and where the needle pipe is penetrating the motherbore tubular at an opening distant from the end of the motherbore tubular;

wherein the needle pipe is equipped with a valve.

14. A pipe device for making lateral openings out of a wellbore in a well formation, the pipe device comprising:

a motherbore tubular disposed in the wellbore;

a needle pipe having at least one pipe section having an end that is aimed at the well formation, the at least one pipe section being coupled to at least one of the motherbore tubular and a pipe coupled to the motherbore tubular;

wherein the at least one pipe section is telescopically movable with respect to the at least one of the motherbore tubular and pipe coupled to the motherbore tubular from a first retracted position to a second extended position in which the needle pipe penetrates through an opening in the motherbore tubular at a location distant from an end of the motherbore tubular.

15. A pipe device according to claim 14, wherein the at least one pipe section of the needle pipe is positioned inside the motherbore tubular.

16. A pipe device according to claim 14, wherein the needle pipe is positionable by the help of a tool at an opening in the motherbore tubular.

17. A pipe device according to claim 14, wherein the needle pipe comprises a body that is adapted to place itself at an opening in the motherbore tubular when flowed into the motherbore tubular.

18. A pipe device according to claim 14, wherein subjecting the at least one pipe section of the needle pipe to a differential pressure between a pressure in the motherbore tubular and an annular pressure in the wellbore hydraulically forces the at least one pipe section towards the formation.

19. A pipe device according to claim 14, wherein the needle pipe comprises a filter.

20. A pipe device according to claim 14, wherein the needle pipe comprises another pipe section and wherein at least one of the pipe sections of the needle pipe is spliceable.

* * * * *